US006966157B1

(12) United States Patent
Sandow

(10) Patent No.: US 6,966,157 B1
(45) Date of Patent: Nov. 22, 2005

(54) STANDING SEAM SKYLIGHT

(76) Inventor: Kiyoshi Sandow, 15 New Oak Trail, Humble, TX (US) 77356

( * ) Notice: Subject to any disclaimer, the term of this patent is extended or adjusted under 35 U.S.C. 154(b) by 174 days.

(21) Appl. No.: 10/632,744

(22) Filed: Aug. 1, 2003

(51) Int. Cl.[7] ..... E04B 7/18

(52) U.S. Cl. ..... 52/200; 52/202; 52/537; 52/506.01; 52/802.1

(58) Field of Search ..... 52/200, 309.5, 52/309.3, 202, 201, 107, 45, 204.5, 506.01, 52/788.1, 802.1, 28, 38, 39, 171.1, 536, 537, 52/203, DIG. 16, DIG. 17; 40/578, 561; 362/147

(56) References Cited

U.S. PATENT DOCUMENTS 4,117,638 A 10/1978 Kidd, Jr. et al.
4,559,753 A * 12/1985 Brueske ..... 52/748.1
4,649,680 A 3/1987 Weisner et al.
4,730,426 A 3/1988 Weisner et al.
4,733,505 A * 3/1988 Van Dame ..... 52/22
4,848,051 A 7/1989 Weisner et al.
4,860,511 A * 8/1989 Weisner et al. ..... 52/200
5,016,406 A * 5/1991 Calam et al. ..... 52/58
5,018,333 A * 5/1991 Bruhm ..... 52/741.4
5,062,247 A * 11/1991 Dittmer ..... 52/200
5,323,576 A 6/1994 Gumpert et al.
5,687,514 A * 11/1997 Gillispie ..... 52/58
5,791,092 A * 8/1998 Strieter ..... 52/27
6,263,624 B1 * 7/2001 Hoy et al. ..... 52/200
6,308,480 B1 * 10/2001 Haney ..... 52/302.6
6,487,827 B2 * 12/2002 Hollman ..... 52/455

* cited by examiner

*Primary Examiner*—Naoko Slack
*Assistant Examiner*—Chi Q. Nguyen
(74) *Attorney, Agent, or Firm*—Keeling Hudson, LLC; Kenneth A. Keeling

(57) ABSTRACT

A skylight for a standing seam roof having a skylight panel housed in a frame with a vertically extending curb along two longitudinal and two lateral sides. The frame curb integrates on the longitudinal sides with U-shaped curbs formed into modified roof panels selected from the construction project. On the lateral sides, the frame curb integrates with curbs formed in two end pieces painted with the other roof panels in the project. Standing seams, which are raised above the surface of the roof, interconnect the regular roof panels. The modified roof panels interconnect with the standing seams of the regular roof panels. The lateral sides of the skylight assembly traverse at least one standing seam when integrated with the regular roof panels.

15 Claims, 7 Drawing Sheets

STANDING SEAM SKYLIGHT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention is generally related to roofing skylights and more specifically to modularly integrated skylights for standing seam roofs.

2. Description of the Related Art

Skylights installed in roofs are widely practiced. In roofs with a standing seam roofing system prior art skylights have been affixed to adjacent roof panels by utilizing the standing seams of those roof panels.

U.S. Pat. No. 4,649,680 issued to Weisner et al. on Mar. 17, 1987, discloses a skylight system for a standing seam roof in which plastic skylight sections are formed to have the same width as a standard metal roof panel and shaped to integrate into the standing seam roof in place of a standard metal roof panel between two standing seams. U.S. Pat. No. 4,117,638 issued to Kidd, Jr. et al. on Oct. 3, 1978, discloses a skylight panel where the transparent panel is shaped to clip into the standing rib interface in place of a metal central panel.

U.S. Pat. No. 4,730,426 issued to Weisner, et al. on Mar. 15, 1988 discloses a skylight for a barrel tile roof. The skylight is made of plastic and folded along the edges to mate with the standing seams on each side of the skylight. The width of the skylight is the width of an integral number of roof tiles, creating joints at each standing seam.

Other prior art skylights are installed into the flat portion of the roof panel between the standing seams.

U.S. Pat. No. 5,323,576 issued to Gumpert et al. on Jun. 28, 1994, discloses a skylight system for use on metal standing seam roofs. The skylight is curbless and integrates into the flat metal panel between two adjacent standing seams. The roof panel is cut and the edges are folded back to form a lip over which a bubble-shaped covering is placed and sealed. In this manner, material is shed off the roof between the two standing seams and able to flow past the skylight.

U.S. Pat. No. 4,848,051 issued to Weisner et al. on Jul. 18, 1989, discloses a low profile skylight for a shingled sloping roof with a unitary rectangular frame having an upstanding standing seam element along each longitudinal edge. Head and sill flashings are provided to seal the remaining perimeter of the skylight.

U.S. Pat. No. 4,860,511 issued to Weisner et al. on Aug. 29, 1989, discloses a curbless skylight having a central dome and a pair of standing seam edges suitable for installation in a metal standing seam roof, wherein the standing seam edges are joined to adjacent metal standing, seams with the same covered by battens.

It would be an improvement to the field to provide a skylight for standing seam roofs that spans across at least one standing seam, and integrated into a section of the standing seam panels, so as to be installed into the roof as a unitary component. It would be an improvement to the field to have the skylight assembly match the color of the metal standing seam roof.

BRIEF SUMMARY OF THE INVENTION

Accordingly, the objects of my invention are to provide, inter alia, a skylight for a standing seam roof that:

- integrates into the standing seam connection system of the remainder of the roof;
- accommodates a skylight panel that may span at least one standing seam; and
- integrates into different types of standing seam connectors.

Other objects of my invention will become evident throughout the reading of this application.

My invention is a skylight for a standing seam roof comprising a durable gauge skylight panel frame integrated into at least one section of the particular roofing material being used.

DESCRIPTION OF THE INVENTION

The preferred embodiment of my standing seam skylight assembly is shown in FIGS. 1–8. The standing seam skylight assembly is depicted as 10.

Figure 10:
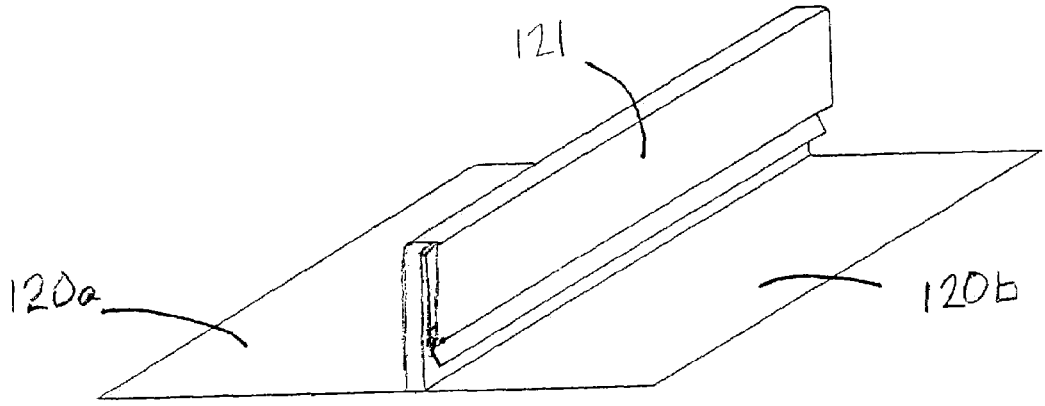
FIG. 10 (PRIOR ART)
FIG. 10 is a perspective view of a prior art standing seam connection.
Figure 11:
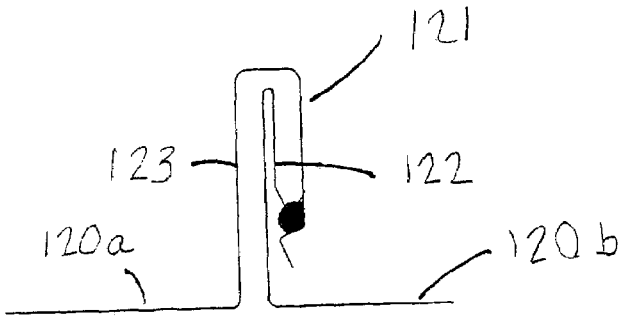
FIG. 11 (PRIOR ART)
FIG. 11 is a side view of a prior art standing seam connection.

Referring to FIGS. 10 and 11, a prior art typical standing seam 121 is shown. Typical standing seam 121 joins two typical roof panels 120*a* and 120*b*. Each roofing panel in a project has a typical inner connector 122 along one edge and a typical outer connector 123 along the opposing edge. FIG. 11 depicts typical standing seam 121, which is created by inserting typical inner connector 122 along one side of typical roof panel 120*b* into typical outer connector 123 of one side of typical roof panel 120*a* in an interference fit. In this manner, many roofing panels can be joined to form a complete roof.

Figure 1:
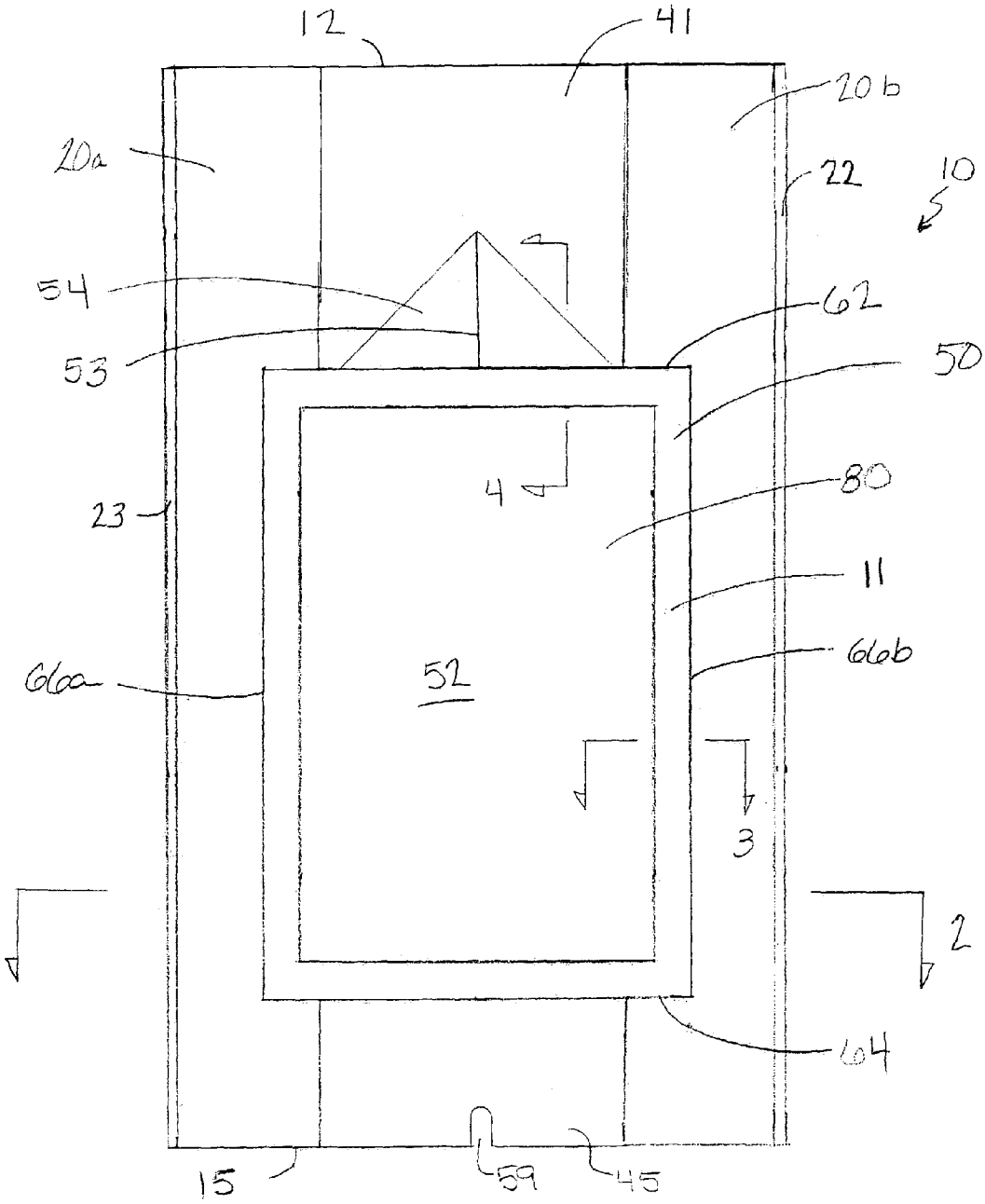
FIG. 1 is a top view of the preferred embodiment of the skylight assembly for a standing seam roof.

Referring to FIG. 1, standing seam skylight assembly 10 is comprised of a skylight frame assembly 50, two roof panels 20*a* and 20*b*, a top end piece 41, and a bottom end piece 45. Roof panels 20*a* and 20*b* are immediately adjacent opposing sides of skylight frame assembly 50. Top end piece 41 and bottom end piece 45 are located between roof panels 20*a* and 20*b* and are immediately adjacent opposing ends of skylight frame assembly 50. Top end piece 41 and bottom end piece 45 may partially overlap each roof panel 20*a* and 20*b*. Skylight assembly 10 has skylight assembly upper edge 12 and skylight assembly lower edge 15. Skylight assembly upper edge 12 is at a higher elevation than skylight assembly lower edge 15 when skylight assembly 10 is integrated into a sloped roof.

Figure 5:
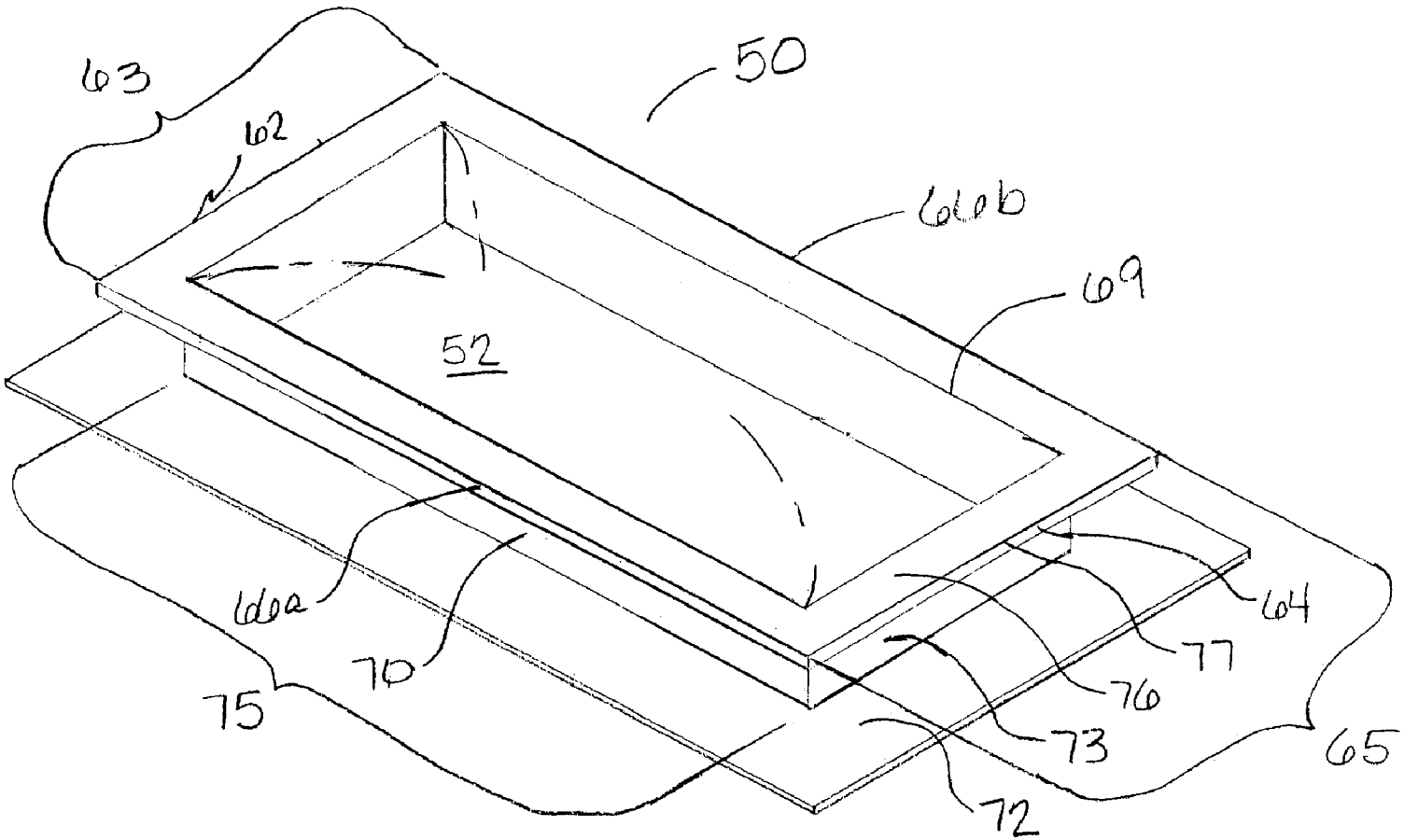
FIG. 5 is a perspective view of an embodiment of the skylight frame assembly.

Referring to FIG. 5, the skylight frame assembly 50 comprises a skylight curb 70 and a translucent or transparent skylight panel 52. Skylight frame assembly 50 has an upper end 62, a lower end 64, and two longitudinal sides 66*a* and 66*b*. Upper end 62 is that end with a higher elevation along the pitch of a sloped roof when skylight assembly 10 is installed in a sloped roof. Upper end 62 has a top frame width 63. Lower end 64 has a lower frame width 65. Lower end 64 and upper end 62 are along opposing ends of skylight frame assembly 50. Each of the two longitudinal sides 66*a* and 66*b* extends between the extremities of upper end 62 and lower end 64 to form a rectangular frame shape. Skylight curb 70 houses skylight panel 52. Skylight curb 70 has an inner periphery 69 defined as that part of skylight curb 70 immediately adjacent and surrounding skylight panel 52. A skylight curb length 75 is the longitudinal length of skylight curb 70.

Figure 3:
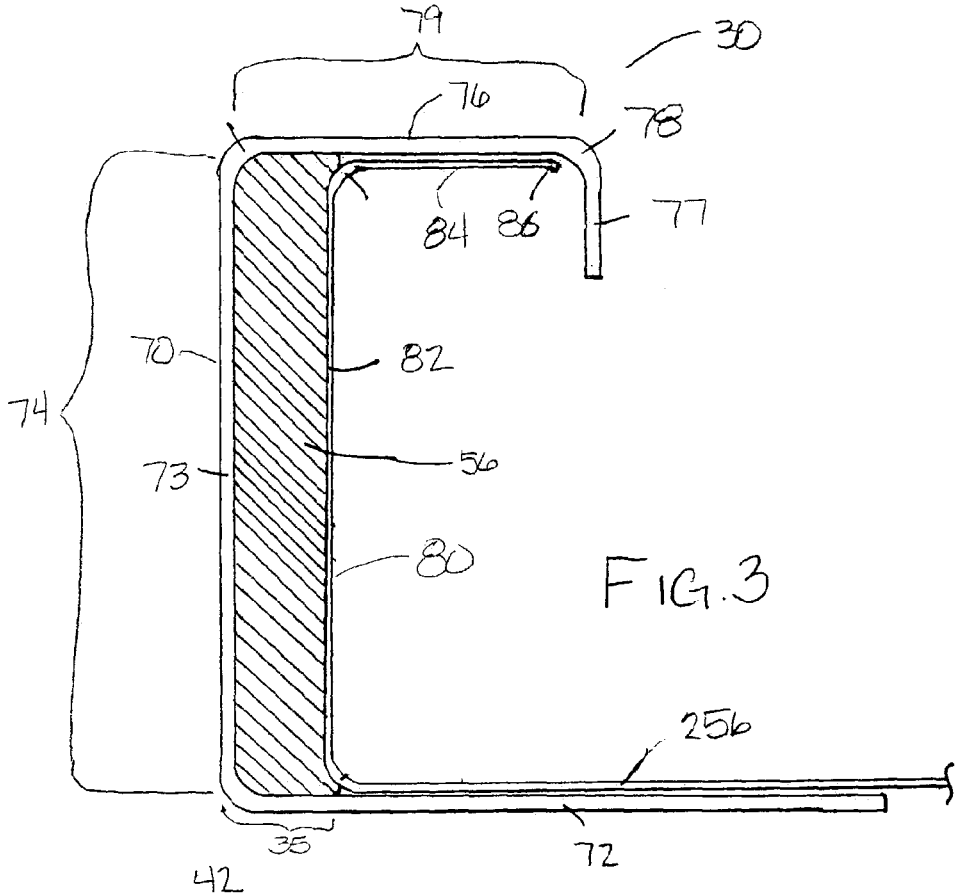
FIG. 3 is an enlarged cross-sectional view of an embodiment of the skylight frame interface with a modified standing seam roof panel.

Referring to FIGS. 3 and 5, skylight curb 70 extends around skylight panel 52 and is C-shaped with the open portion of the "C" facing away from inner periphery 69. In the exemplary embodiment, skylight curb 70 comprises a frame ledge 72, a skylight curb side member 73, a skylight curb top member 76, and a skylight curb lip 77. Skylight curb side member 73 encompasses inner periphery 69 of skylight curb 70. Skylight curb side member 73 and frame ledge 72 are adjoined perpendicularly along a common edge while skylight curb top member 76 is adjoined perpendicularly to the opposing edge of skylight curb side member 73. Frame ledge 72 and skylight curb top member 76 are positioned such that skylight curb top member 76 is parallel to and overhangs frame ledge 72. A skylight curb height 74 is defined as the distance between facing surfaces of skylight curb top member 76 and frame ledge 72. Skylight curb lip 77 is perpendicularly adjoined to skylight curb top member 76 along an outer corner 78, distal skylight curb side member 73 and extends toward frame ledge 72, thus forming a C-shape. A skylight curb width 79 is defined as the distance between facing surfaces of skylight curb side member 73 and skylight curb lip 77.

Figure 2:
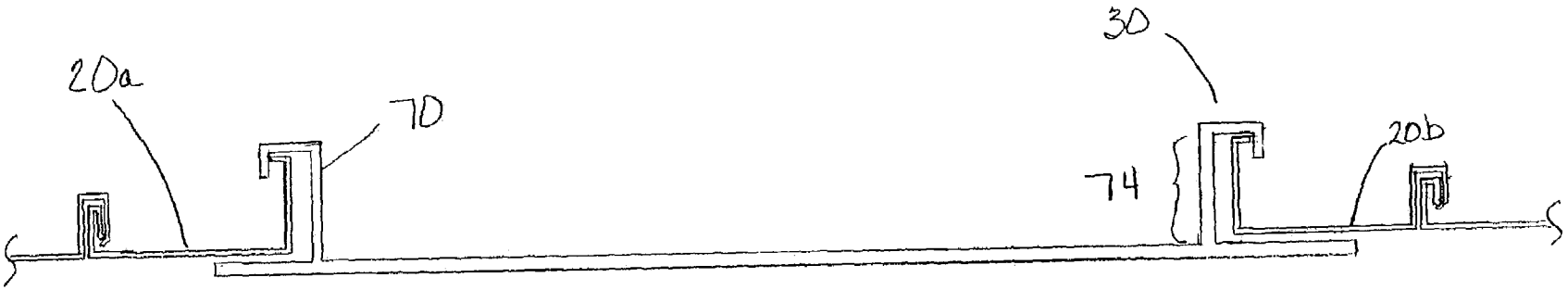
FIG. 2 is a cross-sectional view of the preferred embodiment of the skylight frame interlocking with modified standing seam roof panels.

Referring to FIGS. 2 and 3, the exemplary embodiment of the interface, curb interface 30, between skylight curb 70 and roof panels 20*a* and 20*b* is shown. Roof panels 20*a* and 20*b* are each adapted to interface with skylight curb 70 along longitudinal sides 66*a* and 66*b*.

Figure 6:
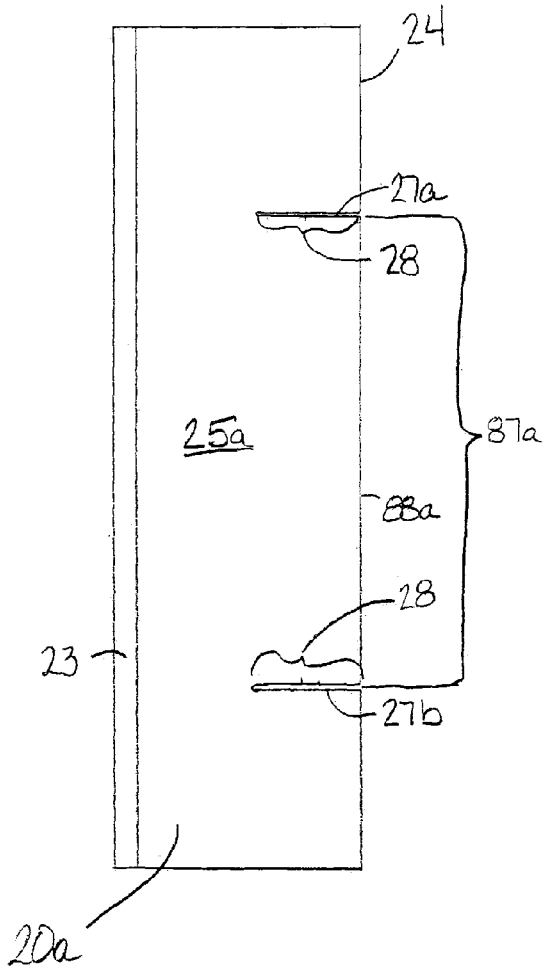
FIG. 6 is a top view of a partially modified roof panel.
Figure 7:
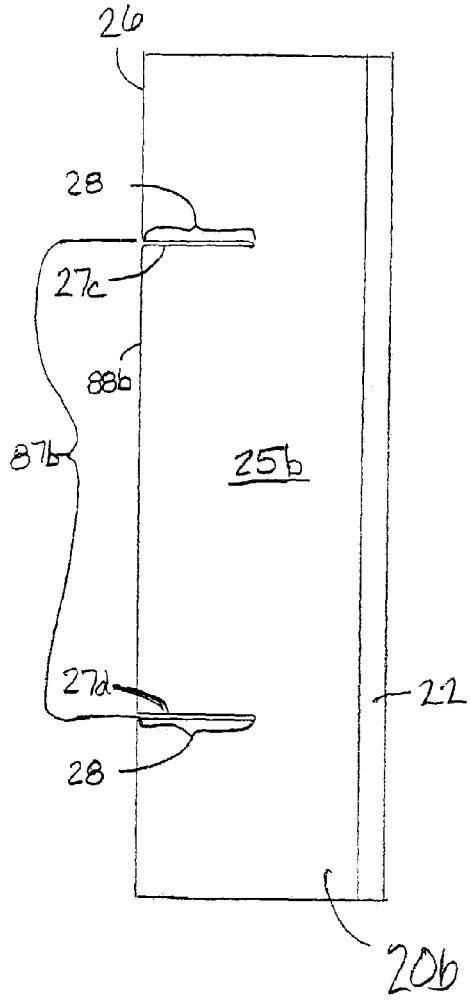
FIG. 7 is a top view of a partially modified roof panel.

Referring to FIGS. 6 and 7, roof panels, 20*a* and 20*b* are shown. Roof panels 20*a* and 20*b* are selected from roofing panels that are to be used in the roofing project. Roof panels 20*a* and 20*b* are modified to accommodate skylight frame assembly 50. As shown in FIG. 6, to prepare roof panels 20*a* and 20*b* for assembly with skylight frame, assembly 50, the inner connector (not shown) of one roof panel 20*a* is removed leaving an inner connector edge 24, which is straight. An outer connector 23 remains along the edge opposing inner connector edge 24. FIG. 7 shows roof panel 20*b* with the outer connector (not shown) removed, leaving an outer connector edge 26, which is also straight. An inner connector 22 remains along the edge opposite outer connector edge 26. Outer connector 23 and inner connector 22 may be referred to herein as panel attachment members. Inner connector edge 24 and outer connector edge 26 may be referred to herein as frame interface edges.

Two slits 27*a* and 27*b* are cut into a panel surface 25*a* of roof panel 20*a* from inner connector edge 24 in a direction perpendicular to inner connector edge 24. Similarly, two slits 27*c* and 27*d* are cut perpendicular to outer connector edge 26 from outer connector edge 26 into panel surface 25*b* of roof panel 20*b*. Some material along inner connector edge 24 outside slits 27*a* and 27*b* may be removed as may some material along outer connector edge 26 outside slits 27*c* and 27*d*.

The edge between slits 27*a* and 27*b* is a panel curb, edge 88*a* and the edge between slits 27*c* and 27*d* is a panel curb edge 88*b*. The distance between slits 27*a* and 27*b* on roof panel 20*a* is a panel curb length 87*a* and between slits 27*c* and 27*d* on roof panel 20*b* is a panel curb length 87*b*. Panel curb lengths 87*a* and 87*b* are each equivalent to skylight curb length 75 plus an allowance for a curb thickness 35, shown in FIG. 4, which will be present at the interfaces between skylight curb 70 and top end piece 41 and skylight curb 70 and bottom end piece 45, discussed below. The distance between panel curb edge 88*a* and the ends of slit 27*a* and 27*b* is a slit length 28, which is equivalent to the sum of skylight curb height 74 and skylight curb width 79. Surface material between slits 27*a* and 27*b* and between slits 27*c* and 27*d* may have to be removed to accommodate top frame width 63 and lower frame width 65 while maintaining the proper slit length 28. Panel surface 25*a* between slits 27*a* and 27*b* on roof panel 20*a* and panel surface 25*b* between slits 27*c* and 27*d* on roof panel 20*b* are bent to form a panel curb 80, shown in FIG. 8.

Figure 8:
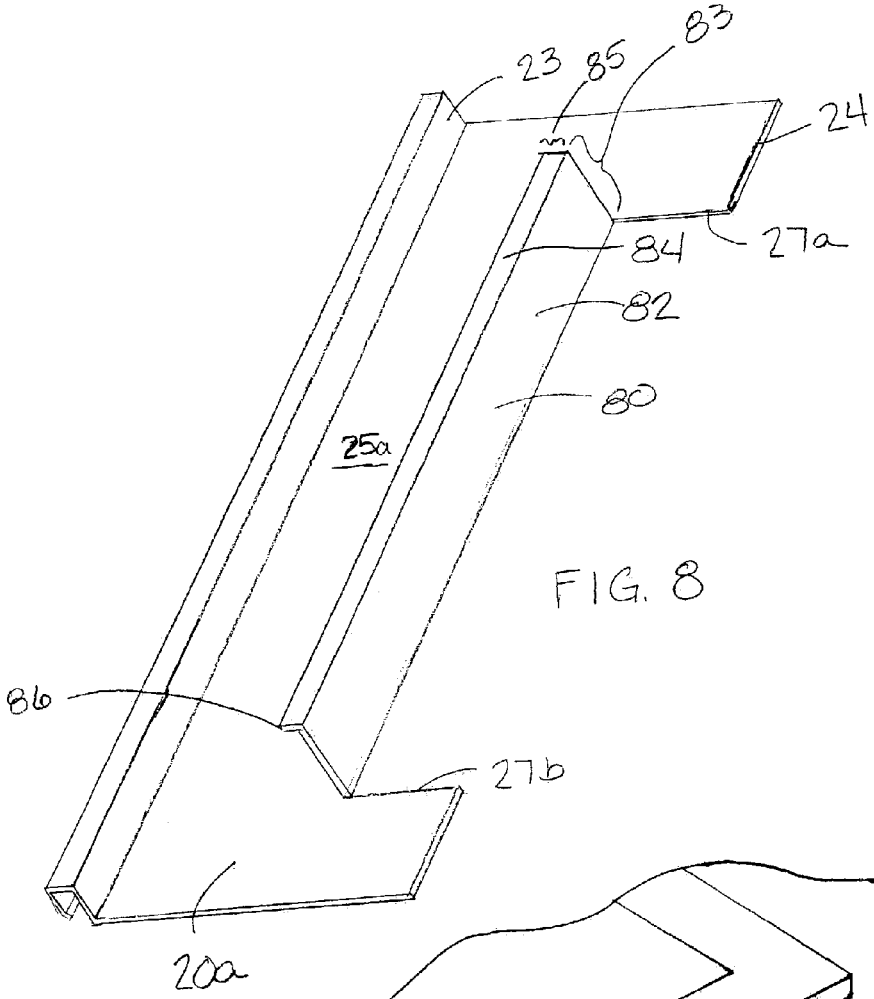
FIG. 8 is a perspective view of a modified roof panel.

Referring to FIG. 8, in the exemplary embodiment, panel curb 80 comprises a panel surface 25*a*, a panel curb side 82, and a panel curb lip 84. Panel curb 80 is formed by bending roof panel 20*a* along panel surface 25*a* between slits 27*a* and 27*b* perpendicular to the panel surface 25*a* to form panel curb side 82. Panel surface 25*a* is bent such that panel curb side 82 extends upwards, in the same direction as outer connector 23 along the edge opposite inner connector edge 24 of roof panel 20*a*. Panel curb side 82 is then bent toward outer connector 23 of the roof panel 20*a* so that it is parallel to and overhangs panel surface 25*a*, thereby forming panel curb lip 84. Thus, panel curb 80 is U-shaped. A panel curb end 86 is located along the free edge of panel curb lip 84. Panel curb 80 has a height 83 and panel curb lip 84 has a width 85. The height 83 of panel curb 80 and the width 85 of panel curb lip 84 are such that panel curb 80 has an edge shape firmly receivable within the shape of the skylight curb 70. As shown in FIG. 3, the U-shape of panel curb 80 fits within the C-shape of skylight curb 70 along longitudinal sides 66*a* and 66*b*. Roof panel 20*b* is prepared in the same manner as roof panel 20*a* with panel curb 80 formed along outer connector edge 26 between slits 27*c* and 27*d*.

Referring to FIG. 3, the interface between roof panel 20*b* panel curb 80 and skylight curb 70 is shown. Insulation 56, which is optional, but preferably included, is also shown, snugly sandwiched between panel curb 80 and skylight curb 70. Panel curb side 82 of panel curb 80, abuts against the insulation 56. The snug fit of insulation 56 against panel curb side 82 causes panel curb end 86 to press against the inside of skylight curb lip 77 at outer corner 78. The tension between the U-shaped panel curb 80 and the C-shaped skylight curb 70 results in panel surface 25*b* and frame ledge 72 abutting parallel, such that frame ledge 72 provides support and rigidity to panel surface 25*b*.

Referring to FIG. 1, top end piece 41 and bottom end piece 45 are shown along upper end 62 and lower end 64 of skylight frame assembly 50. In the preferred embodiment, both top end piece 41 and bottom end piece 45 are made from one or more flat sheets of roofing material obtained with roof panels 20*a* and 20*b* for the roofing project. Thus, top end piece 41 and bottom end piece 45 match the color of the roofing project. Top and bottom end pieces 41 and 45 interface with top and lower ends 62 and 64 of skylight frame assembly 50 in a manner similar to the interface between roof panels 20*a* and 20*b* and skylight frame assembly 50 along longitudinal sides 66*a* and 66*b*.

Figure 4:
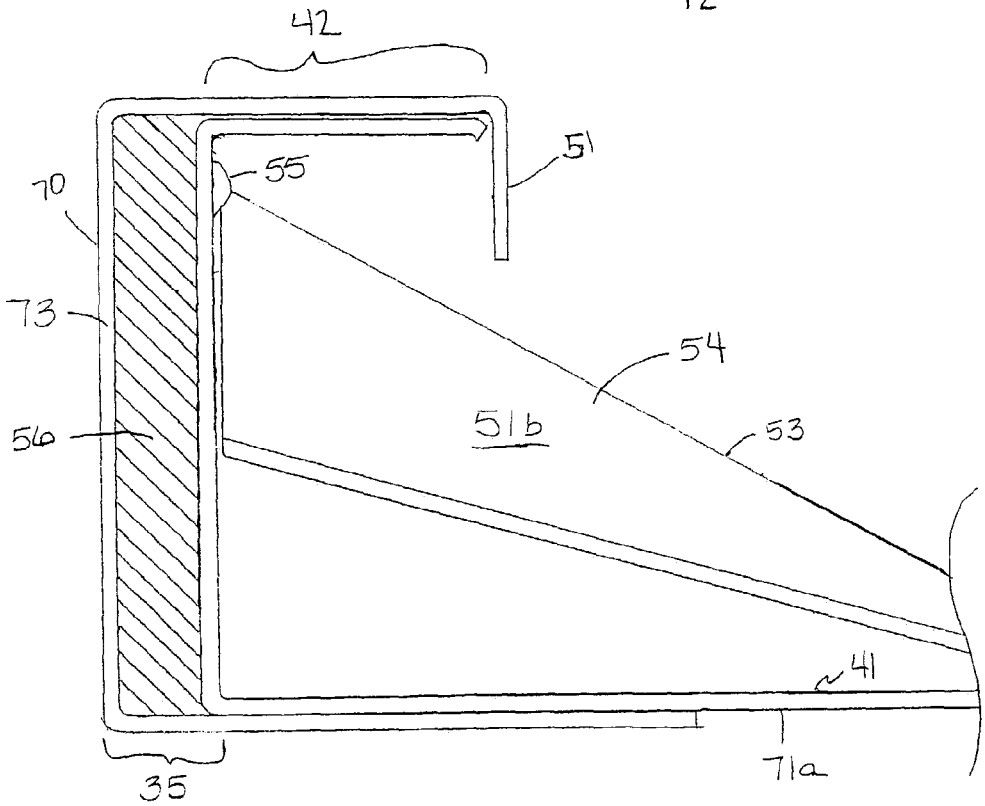
FIG. 4 is an enlarged cross-sectional view of an embodiment of the skylight frame interface with top end piece and a water diverter.

FIG. 4 depicts the interface between top end piece 41 and skylight curb 70. In the exemplary embodiment, top end piece 41 has a U-shaped curb section 42 along the side interfacing with skylight curb 70 and is otherwise flat. U-shaped curb section 42 of top end piece 41 interlocks with the C-shape of skylight curb 70. Insulation 56 is preferably included between curb section 42 and skylight curb 70. Curb thickness 35 is the thickness of insulation 56 plus the immediately adjacent surfaces of top end piece 41 and skylight curb side member 73. The interface along lower end 64 of skylight frame assembly 50 with bottom end piece 45 is the same as that just described. Appropriate roofing sealer (not shown) is optional, but may be used where frame ledge 72 of skylight curb 70 and top and bottom end pieces 41 and 45 overlap. Roof panels 20*a* and 20*b* overlap top end piece 41 and bottom end piece 45 to provide additional support to the surface of roof panels 20*a* and 20*b* and to prevent leakage. Therefore, panel curb length 87 must allow for curb thickness 35 in addition to skylight curb length 75.

Referring to FIGS. 1 and 4, a water diverter 54, also known as a cricket, may be affixed to top end piece 41. Many types of water diverters 54 are practiced in the skylight industry and may be used to divert water around skylight frame assembly 50. One type of water diverter 54 attaches to top end piece 41 at diverter attachment point 55. From diverter attachment point 55, water diverter 54 slants downward and is affixed to top end piece 41. Water diverter 54 has a centrally-located fold 53 thereby forming two triangularly-shaped sloped surfaces 51*a* and 51*b* extending from fold 53 to top end piece 41. Thus, water flowing down skylight assembly 10 is diverted from skylight frame assembly 50, preventing leakage. Other styles of water diverters, which are not depicted, include components that have walls raised vertically from the roof panel surface rather than trianguarly-shaped surfaces. The walls are positioned such that they direct flowing water away from the skylight frame assembly 50.

Figure 9:
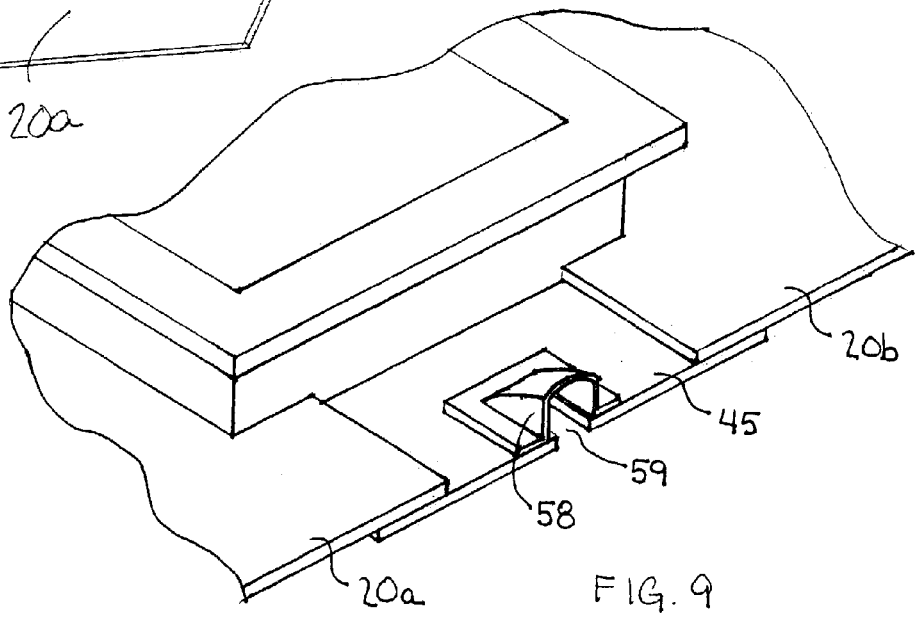
FIG. 9 is a perspective view of a notch and cap on the lower edge of the skylight assembly.

Referring to FIGS. 1 and 9, when skylight assembly 10 is used in a roofing project, skylight assembly lower edge 15 may be located such that it overlaps the top of other roofing panels (not shown) used in the project. Because skylight assembly 10 may be wider than the roofing panels in the project, one or more notches 59 are cut along the skylight assembly lower edge 15 to accommodate the standing seam(s) (not shown) of the lower adjacent roof panels (not shown). When skylight assembly 10 is the width of two roofing panels, one standing seam (not shown) is traversed by skylight assembly 10 and one notch 59 is cut along skylight assembly lower edge 15. When skylight assembly 10 is the width of three roofing panels, two standing seams are traversed by the skylight assembly 10 and two notches 59 are cut along skylight assembly lower edge 15 and so on. Caps 58 are placed over the end of each of the lower adjacent standing seams. Other roofing panels in the project might be located such that they overlap skylight assembly upper edge 12. When necessary, caps 58 are placed over the end of the standing seams of these roofing panels as well.

Referring again to FIG. 1, skylight frame assembly 50 is constructed of material sufficiently rigid enough to support skylight panel 52. Once skylight frame assembly 50 is integrated into roof panels 20*a* and 20*b* and top and bottom end pieces 41 and 45, it can then be employed in a roofing project similar to other panels in the project, with outer connector 23 on roof panel 20*a* connecting to an inner connector (not shown) of an adjacent roof panel (not shown) and inner connector 22, of roof panel 20*b* connecting to outer connector (not shown) of an adjacent roof panel (not shown).

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A skylight assembly for integration into a standing seam roof, said standing seam roof having a plurality of roof panels and a plurality of standing seams, said plurality of standing seams each connecting adjoining said plurality of roof panels, said skylight assembly comprising:

a skylight frame including an upper end, a first side, a lower end and a second side;

a skylight curb vertically extending from said skylight frame along said upper end, said first side, said lower end and said second side;

said skylight curb having an inner periphery;

a skylight panel housed in said inner periphery;

a first roof panel;

said first roof panel having an outer connector, a first panel surface and a first panel curb;

said first panel surface intermediate said outer connector and said first panel curb;

said first panel curb extending vertically from said first panel surface distal said outer connector;

said first panel curb interlocking within said skylight curb along said first side;

a second roof panel;

said second roof panel having an inner connector, a second panel surface and a second panel curb;

said second panel surface intermediate said inner connector and said second panel curb;

said second panel curb extending vertically from said second panel surface distal said inner connector;

said second panel curb interlocking within said skylight curb along said second side;

a top end piece having a top end curb;

said top end curb interlocking within said skylight curb along said skylight upper end;

a bottom end piece having a bottom end curb;

said bottom end curb interlocking within said skylight curb along said skylight lower end;

said first roof panel and said second roof panel each overlapping said bottom end piece; and said inner connector and said outer connector connecting to said adjacent roof panels.

2. The skylight assembly of claim 1, wherein said skylight curb further comprises:

a side member extending upward from said skylight frame;

said side member encompassing said inner periphery of said skylight curb;

a top member extending from said side member away from said inner periphery; and a skylight curb lip extending downward from said top member.

3. The skylight assembly of claim 2, further comprising:

said first panel curb including a first panel curb side extending upward from said first panel surface and a first panel curb lip extending from said first panel curb side and overhanging said first panel surface; and said second panel curb including a second panel curb side extending upward from said second panel surface and a second panel curb lip extending from said second panel curb side and overhanging said second panel surface.

4. The skylight assembly of claim 3, further comprising:

insulation intermediate said first panel curb side and said side member along said first side;

insulation intermediate said second panel curb side and said side member along said second side;

insulation intermediate said top end curb and said side member along said upper end; and insulation intermediate said bottom end curb and said side member along said lower end.

5. The skylight assembly of claim 4, further comprising:

a water diverter attached to said top end piece.

6. The skylight assembly of claim 5, further comprising:

said skylight assembly traversing at least one standing seam, each of said at least one standing seam including a seam end;

at least one notch cut into a lower edge of said lower end piece;

said at least one notch fitting around a seam end of an adjacently located said at least one standing seam;

at least one cap connected to said lower edge of said lower end piece; and each of said at least one cap covering each of said at least one notch and each said seam end.

7. The skylight assembly of claim 6, wherein said first roof panel and said second roof panel are selected from said plurality of roof panels.

8. The skylight assembly of claim 7, wherein said roof panels have been painted a selected color, said skylight assembly further comprising:

said first and second roof panels having been simultaneously painted said selected color;

said top end piece having been simultaneously painted said selected color; and said bottom end piece having been simultaneously painted said selected color.

9. The skylight assembly of claim 1, wherein said plurality of roof panels each have a panel width intermediate each of said plurality of standing seams, said skylight assembly further comprising:

a skylight assembly width intermediate said inner connector and said outer connector; and said skylight assembly width being greater than said panel width.

10. A skylight assembly for integration into a standing seam roof, said standing seam roof having a plurality of roof panels and a plurality of standing seams, said plurality of standing seams each connecting adjoining said plurality of roof panels, said skylight assembly comprising:

a skylight frame;

a skylight curb comprising a side member, a top member and a skylight curb lip;

said side member vertically extending from said skylight frame;

said top member extending outwardly from said side member;

said skylight curb lip extending downwardly from said top member;

a skylight panel housed within said skylight frame;

a first roof panel having an outer connector and a first panel curb;

said first panel curb having a first panel curb side and a first panel curb lip;

said first panel curb side extending vertically from said first roof panel;

said first panel curb lip extending from said first panel curb side toward said outer connector;

said first panel curb interlocking within said skylight curb;

insulation intermediate said first panel curb side and said skylight curb;

a second roof panel having an inner connector and a second panel curb;

said second panel curb having a second panel curb side and a second panel curb lip;

said second panel curb side extending vertically form said second roof panel;

said second panel curb lip extending from said second panel curb side toward said inner connector;

said second panel curb interlocking within said skylight curb;

insulation intermediate said second panel curb side and said skylight curb;

a top end piece having a top end curb;

said top end curb interlocking within said skylight curb;

insulation intermediate said top end curb and said skylight curb;

a bottom end piece having a bottom end curb;

said bottom end curb interlocking within said skylight curb;

insulation intermediate said bottom end curb and said skylight curb; and said inner connector and said outer connector connecting said skylight assembly with said adjacent roof panels.

11. The skylight assembly of claim 10, further comprising:

a water diverter attached to said top end piece.

12. The skylight assembly of claim 11, further comprising:

said skylight assembly traversing at least one standing seam, each of said at least one standing seam including a seam end;

at least one notch cut into a lower edge of said skylight assembly;

said at least one notch fitting around a seam end of an adjacently located said at least one standing seam;

at least one cap connected to said lower edge of said skylight assembly; and each of said at least one cap covering each of said at least one notch and each said seam end.

13. The skylight assembly of claim 12, wherein said first roof panel and said second roof panel are selected from said plurality of roof panels.

14. The skylight assembly of claim 13, wherein said plurality of roof panels have been painted a selected color, and said first roof panel, said second roof panel, said top end piece and said bottom end piece having been simultaneously painted said selected color.

15. The skylight assembly of claim 10, wherein said plurality of roof panels each have a panel width intermediate each of said plurality of standing seams, said skylight assembly further comprising:

a skylight assembly width intermediate said inner connector and said outer connector; and said skylight, assembly width being greater than said panel width.

* * * * *